US011702319B2

(12) United States Patent
Guo

(10) Patent No.: US 11,702,319 B2
(45) Date of Patent: Jul. 18, 2023

(54) LINTEL ASSEMBLY FOR ELEVATOR AND ELEVATOR SYSTEM

(71) Applicant: Otis Elevator Company, Farmington, CT (US)

(72) Inventor: Jianyong Guo, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/527,814

(22) Filed: Nov. 16, 2021

(65) Prior Publication Data

US 2022/0212895 A1 Jul. 7, 2022

(30) Foreign Application Priority Data

Jan. 7, 2021 (CN) ..... 202110019044.9

(51) Int. Cl.

| | |
|---|---|
| ***B66B 11/02*** | (2006.01) |
| ***B66B 5/00*** | (2006.01) |
| ***B66B 3/00*** | (2006.01) |

(52) U.S. Cl.

CPC ..... *B66B 11/0246* (2013.01); *B66B 3/002* (2013.01); *B66B 5/0087* (2013.01)

(58) Field of Classification Search

CPC ... B66B 5/0087; B66B 3/002; B66B 11/0246; B66B 11/0253

See application file for complete search history.

(56) References Cited

U.S. PATENT DOCUMENTS

| | | | | |
|---|---|---|---|---|
| 3,046,615 | A * | 7/1962 | Sherron | E04H 1/14 16/80 |
| 3,236,013 | A * | 2/1966 | Sherron | E04H 1/14 16/80 |
| 8,505,240 | B2 * | 8/2013 | Nguyen | E05F 1/00 49/248 |
| 11,235,951 | B2 * | 2/2022 | Convard | B66B 11/0253 |
| 2012/0255815 | A1 * | 10/2012 | Koskelainen | B66B 11/0226 187/401 |
| 2017/0297870 | A1 * | 10/2017 | Fauconnet | B66B 11/0226 |
| 2018/0111797 | A1 * | 4/2018 | Fauconnet | B66B 11/0226 |
| 2018/0222723 | A1 * | 8/2018 | Gressien | B66B 5/0087 |
| 2019/0330024 | A1 * | 10/2019 | Durand | B66B 11/0226 |
| 2019/0337764 | A1 * | 11/2019 | Convard | B66B 11/0206 |
| 2022/0212895 | A1 * | 7/2022 | Guo | B66B 5/0087 |

FOREIGN PATENT DOCUMENTS

| | | | |
|---|---|---|---|
| CN | 201614859 U | * | 10/2010 |
| CN | 202417251 U | * | 9/2012 |
| CN | 208561326 U | * | 3/2019 |
| CN | 113772506 A | * | 12/2021 |

* cited by examiner

*Primary Examiner* — Michael A Riegelman
(74) *Attorney, Agent, or Firm* — Cantor Colburn LLP

(57) ABSTRACT

A door lintel assembly for an elevator, and an elevator system. The door lintel assembly includes: a door lintel panel having an opening thereon; a display device, which is installed on the door lintel panel via the opening, and which has a display screen on a first side of the door lintel panel, and electronic components on a second side of the door lintel panel; and a rotation device, which includes a first bracket installed on both sides of the door lintel panel, a second bracket fixedly installed, and a rotation mechanism connecting the first bracket and the second bracket, wherein the rotation mechanism drives the first bracket and the door lintel panel to rotate relative to the second bracket.

16 Claims, 3 Drawing Sheets

LINTEL ASSEMBLY FOR ELEVATOR AND ELEVATOR SYSTEM

FOREIGN PRIORITY

This application claims priority to Chinese Patent Application No. 202110019044.9, filed Jan. 7, 2021, and all the benefits accruing therefrom under 35 U.S.C. § 119, the contents of which in its entirety are herein incorporated by reference.

TECHNICAL FIELD

The present application relates to the field of elevator components, and more specifically, the present application relates to a door lintel assembly for an elevator system.

BACKGROUND

As a tool to improve the walking of passengers between floors or shorten the walking distance of passengers, passenger transportation devices are very common in daily life. As an example, it is particularly common to use elevators in residential buildings or between floors of commercial buildings.

For the elevator, display devices can be provided in an elevator car to input part of information when passengers are taking the elevator, e.g., functional display information such as elevator floor and running direction, or entertaining display information such as advertisements and short videos. The elevator car has three side walls, and a door lintel above a car door, which are used for installing the display devices. In order to prevent the passengers from being delayed when watching the content of the display device and failing to leaving the elevator, the car door lintel is usually selected as the installation position of the display device. At this point, since the car door lintel is in an upper space of the car, it is difficult to complete the disassembly and maintenance work from the inside of the car. Therefore, it is usually necessary to control the car to stop running, and perform the disassembly and maintenance work outside a ceiling of the car, which is relatively complicated and dangerous.

SUMMARY

The present application aims to provide a door lintel assembly for an elevator and an elevator system so as to facilitate the maintenance of an elevator door lintel with a display device.

In order to achieve at least one object of the present application, according to an aspect of the present application, a door lintel assembly for an elevator is provided, which includes: a door lintel panel having an opening thereon; a display device, which is installed on the door lintel panel via the opening, and which has a display screen on a first side of the door lintel panel, and electronic components on a second side of the door lintel panel; and a rotation device, which includes a first bracket installed on both sides of the door lintel panel, a second bracket fixedly installed, and a rotation mechanism connecting the first bracket and the second bracket, wherein the rotation mechanism drives the first bracket and the door lintel panel to rotate relative to the second bracket.

In addition to or instead of one or more of the above features, in another embodiment, the rotation mechanism includes: a first link, a first end of which is hinged to a first end of the first bracket, and a second end of which slides in a sliding groove provided in a length direction at a first end of the second bracket; a second link, a first end of which is hinged to a second end of the first bracket, and a second end of which is hinged to a second end of the second bracket; and a third link, a first end of which is hinged to the second end of the first link, and a second end of which is hinged to a middle part of the second link; wherein the length from the middle part to the first end of the second link is equal to the length of the first link.

In addition to or instead of one or more of the above features, in another embodiment, the rotation mechanism includes: a first link, a first end of which slides in a sliding groove provided in a length direction at a first end of the first bracket, and a second end of which is hinged to a first end of the second bracket; a second link, a first end of which is hinged to a second end of the first bracket, and a second end of which is hinged to a second end of the second bracket; and a third link, a first end of which is hinged to the second end of the first link, and a second end of which is hinged to a middle part of the second link; wherein the length from the middle part to the first end of the second link is equal to the length of the first link.

In addition to or instead of one or more of the above features, in another embodiment, a sliding block is provided at a hinge point between the second end of the first link and the first end of the third link, and the sliding block slides in the sliding groove; or a sliding block is provided at the first end of the first link, and the sliding block slides in the sliding groove.

In addition to or instead of one or more of the above features, in another embodiment, a motor is further included, which drives the sliding block to slide back and forth along the sliding groove.

In addition to or instead of one or more of the above features, in another embodiment, a pressure cylinder is further included, which is provided between the second end of the first bracket and the second end of the second bracket to provide self-locking of a rotational movement of the door lintel panel.

In addition to or instead of one or more of the above features, in another embodiment, an installation position of the display device on the door lintel panel is farther away from the center of rotation than an installation position of the first bracket on the door lintel panel.

In addition to or instead of one or more of the above features, in another embodiment, the door lintel panel is further provided with a first bending portion toward the second side of the door lintel panel at an end away from the center of rotation.

In addition to or instead of one or more of the above features, in another embodiment, a locking mechanism is provided on the first bending portion, and the locking mechanism is configured to restrict the rotational movement of the door lintel panel.

In order to achieve at least one object of the present application, according to another aspect of the present application, an elevator system is further provided, which includes: a car having a first car wall on which a car door is provided, wherein the first car wall has a door lintel installation hole above the car door; and the door lintel assembly as described above; wherein the door lintel panel is installed in the door lintel installation hole, the second bracket is installed on both sides of the exterior of the first car wall, and the rotation mechanism drives the first bracket and the door lintel panel to rotate relative to the second bracket and the first car wall, thereby opening or closing the door lintel installation hole.

In addition to or instead of one or more of the above features, in another embodiment, the first car wall is provided with a cross beam between the car door and the door lintel installation hole; the door lintel panel is further provided with a first bending portion toward the second side of the door lintel panel at an end away from the center of rotation; wherein when the door lintel panel is rotated so that the door lintel installation hole is closed, the first bending portion covers a lower part of the cross beam.

In addition to or instead of one or more of the above features, in another embodiment, the first bending portion and the cross beam are provided with locking mechanisms that cooperate with each other, and the locking mechanisms are configured to restrict the rotational movement of the door lintel panel.

In addition to or instead of one or more of the above features, in another embodiment, the first bending portion is further provided with a second bending portion at a first end away from the door lintel panel; wherein when the door lintel panel is rotated so that the door lintel installation hole is closed, the second bending portion snap-fits with and covers the exterior of the cross beam.

In addition to or instead of one or more of the above features, in another embodiment, the second bracket is installed on left and right sides of the exterior of the first car wall; and the rotation mechanism drives the first bracket and the door lintel panel to rotate upward or downward relative to the second bracket and the first car wall, thereby opening or closing the door lintel installation hole; wherein the center of rotation of the door lintel panel is close to an upper or lower part of the door lintel installation hole.

In addition to or instead of one or more of the above features, in another embodiment, the second bracket is installed on upper and lower sides of the exterior of the first car wall; and the rotation mechanism drives the first bracket and the door lintel panel to rotate leftward or rightward relative to the second bracket and the first car wall, thereby opening or closing the door lintel installation hole; wherein the center of rotation of the door lintel panel is close to a left or right part of the door lintel installation hole.

In addition to or instead of one or more of the above features, in another embodiment, a pressure cylinder is further included, which is provided between the door lintel panel and the first car wall to provide self-locking of a rotational movement of the door lintel panel.

According to the door lintel assembly and the elevator system of the present application, by providing the door lintel assembly with a rotation device, the door lintel panel together with the display device thereon can be opened and closed by rotating, thereby providing better protection for electronic components of the display device, such as protection from dust, water or impact. In addition, when applied to elevators, the present disclosure realizes the opening and closing of the door lintel assembly inside the elevator car and the maintenance of the display device in a limited space, thus presenting a higher maintenance efficiency and operation safety.

| Reference signs | |
|---|---|
| 100 | door lintel assembly |
| 110 | door lintel panel |
| 111 | opening |
| 112 | first bending portion |
| 112a | locking mechanism |
| 113 | second bending portion |
| 120 | display device |
| 121 | display screen |
| 130 | rotation device |
| 131 | first bracket |
| 131a | first end |
| 131b | second end |
| 131c | sliding groove |
| 132 | second bracket |
| 132a | first end |
| 132b | second end |
| 132c | sliding groove |
| 133 | first link |
| 133a | first end |
| 133b | second end |
| 134 | second link |
| 134a | first end |
| 134b | second end |
| 135 | third link |
| 135a | first end |
| 135b | second end |
| 136 | sliding block |
| 137 | pressure cylinder |
| 200 | elevator system |
| 210 | car |
| 211 | first car wall |
| 212 | car door |
| 213 | door lintel installation hole |
| 214 | cross beam |
| 215 | ceiling |

DETAILED DESCRIPTION OF THE EMBODIMENT(S)

Hereinafter, the present application will be described in detail with reference to exemplary embodiments in the accompanying drawings. However, it should be understood that the present application can be implemented in many different forms, and should not be construed as being limited to the embodiments set forth herein. These embodiments are provided herein to make the disclosure of the present application more complete and similar, and to fully convey the concept of the present application to those skilled in the art.

In addition, for any single technical feature described or implied in the embodiments mentioned herein, or any single technical feature shown or implied in individual drawings, the present application still allows these technical features (or equivalents thereof) to be further arbitrarily combined or added or deleted without any technical obstacle, thereby obtaining more other embodiments of the present application that may not have been directly mentioned herein.

Figure 1:
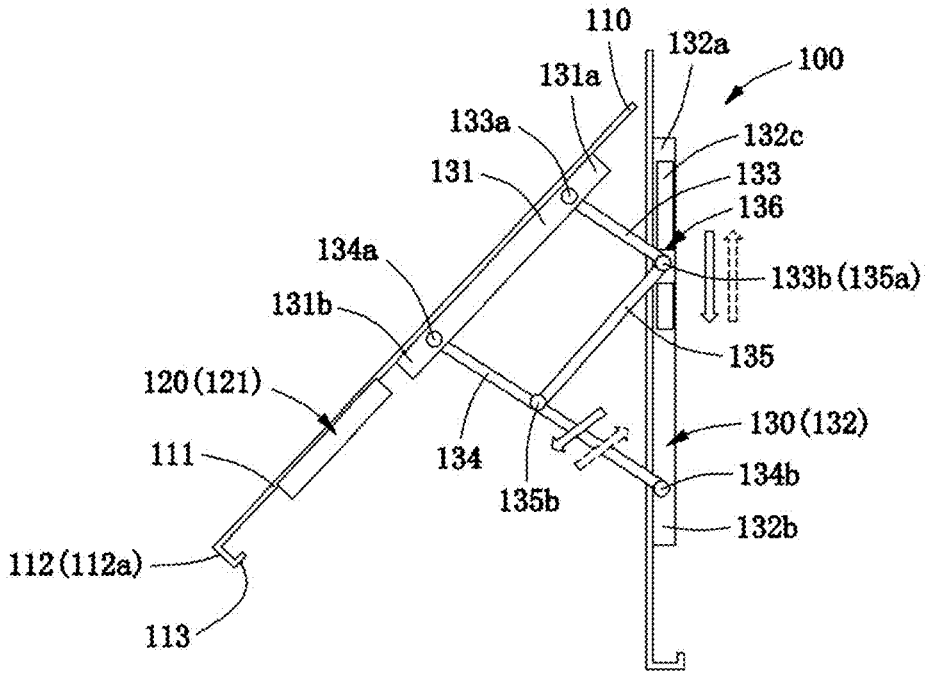
FIG. 1 is a schematic side view of an embodiment of a door lintel assembly for an elevator system.
Figure 2:
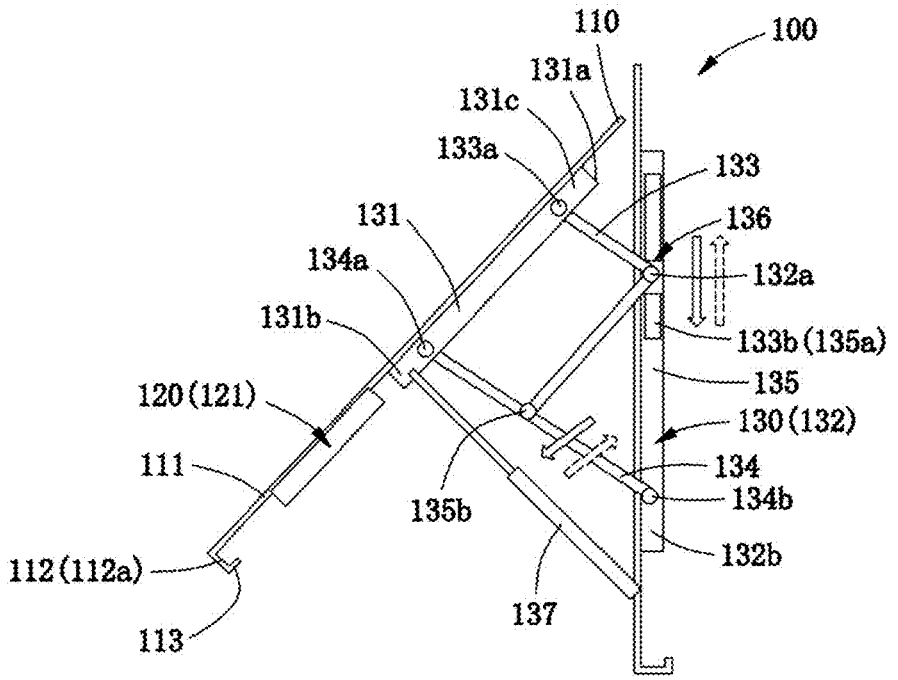
FIG. 2 is a schematic side view of another embodiment of a door lintel assembly for an elevator system.
Figure 3:
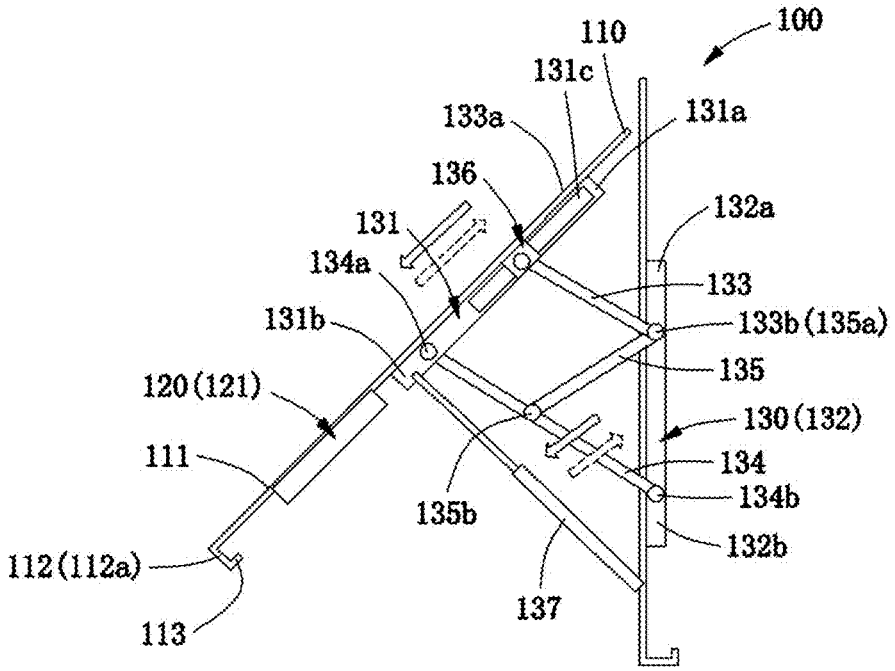
FIG. 3 is a schematic side view of further another embodiment of a door lintel assembly for an elevator system.

In the present application, a door lintel assembly and its application in an elevator system will be exemplarily described with reference to FIGS. 1-6. FIGS. 1 to 3 respectively show the structures and configurations of several embodiments of the door lintel assembly in overall schematic views, while FIGS. 4 to 6 generally show the application of the door lintel assembly in the elevator system. The description will be elaborated as follows.

Referring to FIGS. 1 to 3, the door lintel assembly 100 includes a door lintel panel 110, a display device 120 and a rotation device 130. The door lintel panel 110 has an opening 111 for installing the display device 120. After the installation is completed, the display device 120 has a display screen 121 located outside the door lintel panel 110 and electronic components located inside the door lintel panel 110. In addition, the rotation device 130 mentioned above includes a first bracket 131 installed on both sides of the door lintel panel 110, a second bracket 132 fixedly installed to peripheral parts of the application position, and a rotation mechanism connecting the first bracket 131 and the second bracket 132. As a result, the rotation mechanism drives the first bracket 131 and the door lintel panel 110 to rotate relative to the peripheral parts of the application position to which the second bracket 132 is fixedly installed. With this arrangement, on the one hand, the door lintel panel 110 together with the display device 120 thereon can be opened and closed by rotating, thereby providing better protection for electronic components of the display device 120 inside the door lintel panel 110, such as protection from dust, water or impact; on the other hand, when the present disclosure is specifically applied to the elevator, it can realize the opening and closing of the door lintel assembly inside the elevator car and the maintenance of the display device in a limited space, thus presenting a higher maintenance efficiency and operation safety.

The structures and connection relationships of various components of the door lintel assembly for the elevator will be introduced in combination with three embodiments shown in FIGS. 1 to 3 respectively as follows. In addition, in order to further improve the reliability, practicability, economy or other aspects, some additional components may also be added therein, which will also be exemplified below.

Referring to FIG. 1, the rotation mechanism of the door lintel assembly in this embodiment includes a first link 133, a second link 134 and a third link 135. A first end 133*a* of the first link 133 is hinged to a first end 131*a* of the first bracket 131, and a second end 133*b* of the first link 133 slides in a sliding groove 132*c* provided in a length direction at a first end 132*a* of the second bracket 132; a first end 134*a* of the second link 134 is hinged to a second end 131*b* of the first bracket 131, and a second end 134*b* of the second link 134 is hinged to a second end 132*b* of the second bracket 132; a first end 135*a* of the third link 135 is hinged to the second end 133*b* of the first link 133, and a second end 135*b* of the third link 135 is hinged to a middle part of the second link 134. The connection point at the middle part is such that the length from the middle part to the first end 134*a* of the second link 134 is equal to the length of the first link 133.

In this case, when the opening action is performed, as shown by the solid-line arrows in the figure, the common hinge point of the second end 133*b* of the first link 133 and the first end 135*a* of the third link 135 moves downward relative to the sliding groove 132*c*, so that the second end 135*b* of the third link 135 rotates clockwise and pushes the first end 134*a* of the second link 134 to rotate counterclockwise relative to the second end 135*b* of the third link 135 and the first end 134*b* of the second link 134 at the same time; finally, the rotation is transmitted to the door lintel panel 110 through the first bracket 131, so that the door lintel panel 110 rotates clockwise as shown in a lower part of the figure and the internal electronic components of the display device 120 are exposed.

When the closing action is performed, as shown by the dashed-line arrows in the figure, the common hinge point of the second end 133*b* of the first link 133 and the first end 135*a* of the third link 135 moves upward relative to the sliding groove 132*c*, so that the second end 135*b* of the third link 135 rotates counterclockwise and pushes the first end 134*a* of the second link 134 to rotate clockwise relative to the second end 135*b* of the third link 135 and the first end 134*b* of the second link 134 at the same time; finally, the rotation is transmitted to the door lintel panel 110 through the first bracket 131, so that the door lintel panel 110 rotates counterclockwise as shown in the lower part of the figure and the internal electronic components of the display device 120 are concealed.

In addition, a sliding block 136 may be provided at the hinge point of the second end 133*b* of the first link 133 and the first end 135*a* of the third link 135, and the sliding block 136 slides in the sliding groove 132*c*. At this point, the sliding block can provide a certain self-locking effect relative to the sliding groove 132*c*, so that the door lintel panel can be kept relatively locked when opened to any angle, and will rotate again when being pushed.

Moreover, in order to provide a more convenient maintenance process, the installation position of the display device 120 on the door lintel panel 110 may be set to be farther away from the center of rotation than the installation position of the first bracket 131 on the door lintel panel 110. In this case, when the door lintel panel is opened, the maintenance personnel can observe and maintain the display device 120 more closely.

In addition, in order to improve the protective effect that the door lintel panel can provide, a first bending portion 112 toward a second side of the door lintel panel 110 may be provided at an end of the door lintel panel 110 that is away from the center of rotation. In this case, in the closed state, there is a bend relative to the surrounding parts to further reduce the intrusion of dust. At the same time, a locking mechanism 112*a* may also be provided on the first bending portion 112 to restrict a rotational movement of the door lintel panel 110 by locking.

Turning to FIG. 2, an embodiment of another door lintel assembly is shown. This embodiment has a similar structure and configuration to the embodiment shown in FIG. 1, especially a similar rotation mechanism. Therefore, the rotational opening and closing process of the door lintel panel will not be further elaborated. The following will focus on the differences therebetween.

Specifically, in this embodiment, a motor is additionally provided, which drives the sliding block 136 to slide back and forth along the sliding groove 132*c*, thereby realizing the automatic rotational opening and closing function of the door lintel assembly. In addition, a pressure cylinder 137 it also included, which is provided between the second end 131*b* of the first bracket 131 and the second end 132*b* of the second bracket 132, so as to provide a more stable and reliable self-locking of the door lintel panel 110 at different rotational angles.

Referring to FIG. 3, an embodiment of further another door lintel assembly is shown. This embodiment has a similar partial structure and configuration to the embodiment shown in FIG. 1, but there are differences in the arrangement of the rotation mechanism and the like between the two. The following will focus on the differences therebetween.

The rotation mechanism of the door lintel assembly in this embodiment includes a first link 133, a second link 134 and a third link 135. A first end 133*a* of the first link 133 slides in a sliding groove 131*c* provided in a length direction at a first end 131*a* of the first bracket 131, and a second end 133*b* of the first link 133 is hinged to a first end 132*a* of the second bracket 132; a first end 134*a* of the second link 134 is hinged to a second end 131*b* of the first bracket 131, and a second end 134*b* of the second link 134 is hinged to a second end 132*b* of the second bracket 132; a first end 135*a* of the third link 135 is hinged to the second end 133*b* of the first link 133, and a second end 135*b* of the third link 135 is hinged to a middle part of the second link 134. The connection point at the middle part is such that the length from the middle part to the first end 134*a* of the second link 134 is equal to the length of the first link 133.

In this case, when the opening action is performed, as shown by the solid-line arrows in the figure, the hinge point of the first end 133*a* of the first link 133 and the first bracket 131 moves downward relative to the sliding groove 131*c*, so that the second end 135*b* of the third link 135 rotates clockwise and pushes the first end 134*a* of the second link 134 to rotate counterclockwise relative to the second end 135*b* of the third link 135 and the first end 134*b* of the second link 134 at the same time; the rotation is in turn transmitted to the door lintel panel 110 through the first bracket 131, so that the door lintel panel 110 rotates clockwise as shown in a lower part of the figure and the internal electronic components of the display device 120 are exposed.

When the closing action is performed, as shown by the dashed-line arrows in the figure, the hinge point of the first end 133*a* of the first link 133 and the first bracket 131 moves upward relative to the sliding groove 131*c*, so that the second end 135*b* of the third link 135 rotates counterclockwise and pushes the first end 134*a* of the second link 134 to rotate clockwise relative to the second end 135*b* of the third link 135 and the first end 134*b* of the second link 134 at the same time; the rotation is in turn transmitted to the door lintel panel 110 through the first bracket 131, so that the door lintel panel 110 rotates counterclockwise as shown in the lower part of the figure and the internal electronic components of the display device 120 are concealed.

In addition, a sliding block 136 may be provided at the first end 133*a* of the first link 133, and the sliding block 136 slides in the sliding groove 131*c*. At this point, the sliding block can provide a certain self-locking effect relative to the sliding groove 132*c*, so that the door lintel panel can be kept relatively locked when opened to any angle, and will rotate again when being pushed.

Specifically, this embodiment additionally includes a pressure cylinder 137, which is provided between the second end 131*b* of the first bracket 131 and the second end 132*b* of the second bracket 132, so as to provide a more stable and reliable self-locking of the door lintel panel 110 at different rotational angles.

Figure 4:
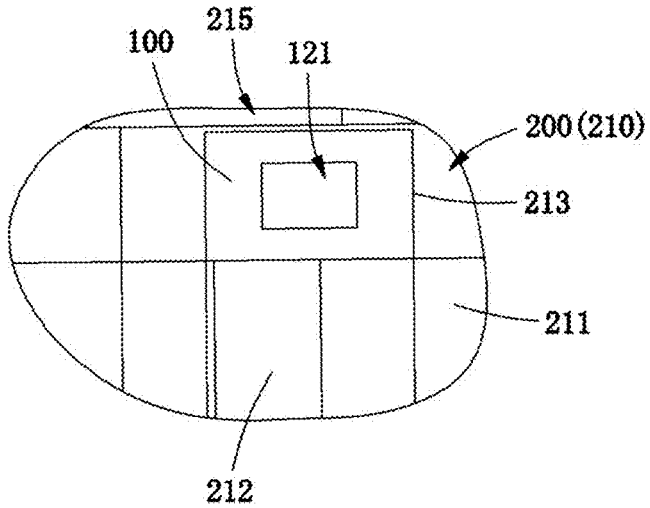
FIG. 4 is a schematic view of an embodiment of an elevator system in which the door lintel assembly is applied, wherein the door lintel assembly is in a closed state.
Figure 5:
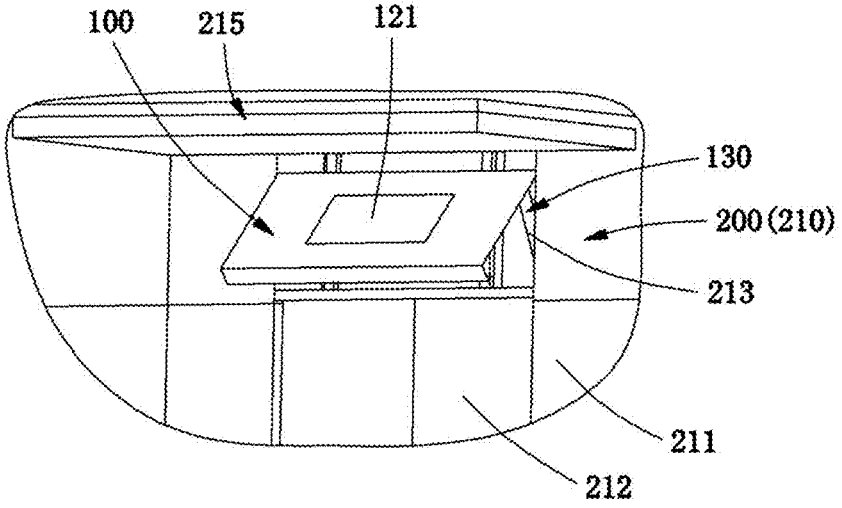
FIG. 5 is a schematic view of an embodiment of an elevator system in which the door lintel assembly is applied, wherein the door lintel assembly is in an open state.
Figure 6:
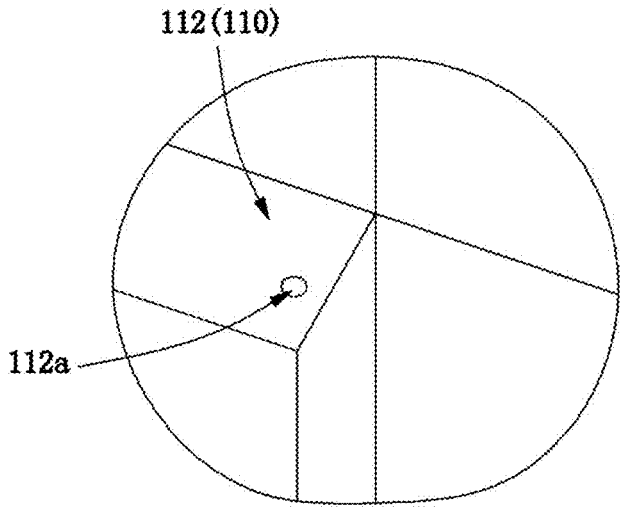
FIG. 6 is a detailed schematic view showing the locking of the door lintel assembly and a cross beam in FIG. 5.

In the present application, an embodiment of an elevator system is also shown in combination with FIGS. 4 to 6. The elevator system 200 includes a car 210 and the door lintel assembly 100 described in any of the foregoing embodiments or combinations thereof. The following will focus on the installation relationships or positional relationships of various components of the door lintel assembly in the car of the elevator system.

Specifically, the car 210 is formed by four car walls, a ceiling 215, and a floor in a surrounding manner A first car wall 211 has a car door 212, and a door lintel installation hole 213 located above the car door 212. The door lintel panel 110 of the door lintel assembly 100 will be installed in the door lintel installation hole 213. The second bracket 132 of the door lintel assembly 100 is installed on both sides of the exterior of the first car wall 211. In addition, the rotation mechanism of the door lintel assembly 100 drives the first bracket 131 and the door lintel panel 110 to rotate relative to the second bracket 132 and the first car wall 211, thereby opening or closing the door lintel installation hole 213. The elevator system under this arrangement provides better protection for the display device 120 thereof, such as protection from dust, water or impact; moreover, the opening and closing of the door lintel assembly inside the elevator car and the maintenance of the display device are realized in a limited space, thus presenting a higher maintenance efficiency and operation safety.

Regarding the installation of the door lintel assembly in the elevator car, there are many simple and feasible solutions, which will be exemplarily described as follows.

As shown in FIGS. 4 to 5, the second bracket 132 in this case is installed on left and right sides of the exterior of the first car wall 211; and the rotation mechanism 130 drives the first bracket 131 and the door lintel panel 110 to rotate upward or downward relative to the second bracket 132 and the first car wall 211, thereby opening or closing the door lintel installation hole 213. In this case, the center of rotation of the door lintel panel is close to an upper or lower part of the door lintel installation hole 213, preferably close to the lower part, so that the door lintel panel can be rotated from bottom to top and opened, thus providing a convenient way of observation and maintenance.

Alternatively, although not shown in the figure, the second bracket 132 may also be installed on upper and lower sides of the exterior of the first car wall 211; and the rotation mechanism 130 drives the first bracket 131 and the door lintel panel 110 to rotate leftward or rightward relative to the second bracket 132 and the first car wall 211, thereby opening or closing the door lintel installation hole 213. In this case, the center of rotation of the door lintel panel 110 is close to a left or right part of the door lintel installation hole 213, so that the door lintel panel can be rotated from left to right or from right to left and opened, thus providing a convenient way of observation and maintenance.

Continuing to refer to FIGS. 4 to 6, in the illustrated embodiment, the first car wall 211 may also be provided with a cross beam 214 between the car door 212 and the door lintel installation hole 213, and the door lintel panel 110 is provided with a first bending portion 112 toward the second side of the door lintel panel 110 at an end away from the center of rotation. When the door lintel panel 110 is rotated so that the door lintel installation hole 213 is closed, the first bending portion 112 covers a lower part of the cross beam 214. At this point, in the closed state, there is a bend relative to the surrounding parts to further reduce the intrusion of dust. At the same time, as shown in FIG. 6, a locking mechanism 112*a* may also be provided on the first bending portion 112, and a locking mechanism 112*a* is correspondingly provided on the cross beam 214, so as to restrict a rotational movement of the door lintel panel 110 by locking.

In addition, in order to provide better locking stability, the first bending portion 112 may be further provided with a second bending portion 113 at a first end away from the door lintel panel 110. When the door lintel panel 110 is rotated so that the door lintel installation hole 213 is closed, the second bending portion 113 snap-fits with and covers the exterior of the cross beam 214. At this point, in the closed state, the second bending portion 113 will snap-fit with the exterior of the cross beam 214. If the door lintel panel 110 needs to opened by rotating, a force needs to be exerted on the door lintel panel 110 first to pull the entire door lintel panel 110 down to cause a small amount of deformation or displacement thereof so that the second bending portion 113 is pulled down from the exterior of the cross beam 214 and disengages from the snap-fit state; then the entire door lintel panel 110 is rotated.

Furthermore, regarding the pressure cylinder already mentioned in the above door lintel assembly, when it is installed in the elevator system, a connection position thereof may also be adjusted; for example, it can be arranged between the door lintel panel and the first car wall, so as to provide a more stable and reliable self-locking of the door lintel panel 110 at different rotational angles.

In the above examples, the door lintel assembly for an elevator and the elevator system of the present application are mainly described. Although only some of the embodiments of the present application have been described, those skilled in the art should understand that the present application may be implemented in many other forms without departing from the spirit and scope thereof. Therefore, the illustrated examples and embodiments should be regarded as illustrative rather than restrictive, and the present application may cover various modifications and replacements without departing from the spirit and scope of the present application as defined by the appended claims.

What is claimed is:

1. A door lintel assembly for an elevator, comprising:

a door lintel panel having an opening thereon;

a display device, which is installed on the door lintel panel via the opening, and which has a display screen on a first side of the door lintel panel, and electronic components on a second side of the door lintel panel; and a rotation device, which comprises a first bracket installed on both sides of the door lintel panel, a second bracket fixedly installed, the first bracket being separate from the second bracket, and a rotation mechanism connecting the first bracket and the second bracket, wherein the rotation mechanism drives the first bracket and the door lintel panel to rotate relative to the second bracket.

2. The door lintel assembly according to claim 1, wherein the rotation mechanism comprises:

a first link, a first end of which is hinged to a first end of the first bracket, and a second end of which slides in a sliding groove provided in a length direction at a first end of the second bracket;

a second link, a first end of which is hinged to a second end of the first bracket, and a second end of which is hinged to a second end of the second bracket; and a third link, a first end of which is hinged to the second end of the first link, and a second end of which is hinged to a middle part of the second link;

wherein the length from the middle part to the first end of the second link is equal to the length of the first link.

3. The door lintel assembly according to claim 2, wherein:

a sliding block is provided at a hinge point between the second end of the first link and the first end of the third link, and the sliding block slides in the sliding groove; or a sliding block is provided at the first end of the first link, and the sliding block slides in the sliding groove.

4. The door lintel assembly according to claim 3, further comprising a motor, which drives the sliding block to slide back and forth along the sliding groove.

5. The door lintel assembly according to claim 2, further comprising a pressure cylinder is further included, which is provided between the second end of the first bracket and the second end of the second bracket to provide self-locking of a rotational movement of the door lintel panel.

6. The door lintel assembly according to claim 2, wherein an installation position of the display device on the door lintel panel is farther away from the center of rotation than an installation position of the first bracket on the door lintel panel.

7. The door lintel assembly according to claim 1, wherein the rotation mechanism comprises:

a first link, a first end of which slides in a sliding groove provided in a length direction at a first end of the first bracket, and a second end of which is hinged to a first end of the second bracket;

a second link, a first end of which is hinged to a second end of the first bracket, and a second end of which is hinged to a second end of the second bracket; and a third link, a first end of which is hinged to the second end of the first link, and a second end of which is hinged to a middle part of the second link;

wherein the length from the middle part to the first end of the second link is equal to the length of the first link.

8. The door lintel assembly according to claim 1, wherein the door lintel panel is further provided with a first bending portion toward the second side of the door lintel panel at an end away from the center of rotation.

9. The door lintel assembly according to claim 8, wherein a locking mechanism is provided on the first bending portion, and the locking mechanism is configured to restrict the rotational movement of the door lintel panel.

10. An elevator system, comprising:

a car having a first car wall on which a car door is provided, wherein the first car wall has a door lintel installation hole above the car door; and a door lintel assembly including:

a door lintel panel having an opening thereon;

a display device, which is installed on the door lintel panel via the opening, and which has a display screen on a first side of the door lintel panel, and electronic components on a second side of the door lintel panel; and a rotation device, which comprises a first bracket installed on both sides of the door lintel panel, a second bracket fixedly installed, and a rotation mechanism connecting the first bracket and the second bracket, wherein the rotation mechanism drives the first bracket and the door lintel panel to rotate relative to the second bracket;

wherein the door lintel panel is installed in the door lintel installation hole, the second bracket is installed on both sides of the exterior of the first car wall, and the rotation mechanism drives the first bracket and the door lintel panel to rotate relative to the second bracket and the first car wall, thereby opening or closing the door lintel installation hole.

11. The elevator system according to claim 10, wherein:

the first car wall is provided with a cross beam between the car door and the door lintel installation hole;

the door lintel panel is further provided with a first bending portion toward the second side of the door lintel panel at an end away from the center of rotation;

wherein when the door lintel panel is rotated so that the door lintel installation hole is closed, the first bending portion covers a lower part of the cross beam.

12. The elevator system according to claim 11, wherein the first bending portion and the cross beam are provided with locking mechanisms that cooperate with each other, and the locking mechanisms are configured to restrict the rotational movement of the door lintel panel.

13. The elevator system according to claim 11, wherein the first bending portion is further provided with a second bending portion at a first end away from the door lintel panel; and wherein when the door lintel panel is rotated so that the door lintel installation hole is closed, the second bending portion snap-fits with and covers the exterior of the cross beam.

14. The elevator system according to claim 10, wherein the second bracket is installed on left and right sides of the exterior of the first car wall; and the rotation mechanism drives the first bracket and the door lintel panel to rotate upward or downward relative to the second bracket and the first car wall, thereby opening or closing the door lintel installation hole; and wherein the center of rotation of the door lintel panel is close to an upper or lower part of the door lintel installation hole.

15. The elevator system according to claim 10, wherein the second bracket is installed on upper and lower sides of the exterior of the first car wall; and the rotation mechanism drives the first bracket and the door lintel panel to rotate leftward or rightward relative to the second bracket and the first car wall, thereby opening or closing the door lintel installation hole; and wherein the center of rotation of the door lintel panel is close to a left or right part of the door lintel installation hole.

16. The elevator system according to claim 10, further comprising a pressure cylinder, which is provided between the door lintel panel and the first car wall to provide self-locking of a rotational movement of the door lintel panel.

* * * * *